United States Patent [19]

Bothner et al.

[11] Patent Number: 4,827,311

[45] Date of Patent: May 2, 1989

[54] APPARATUS FOR CLEANING PARTICULATE MATTER FROM A MOVING WEB

[75] Inventors: Carl R. Bothner, Rochester; Robert M. Peffer, Penfield; Curtis L. Vernon, Rochester, all of N.Y.

[73] Assignee: Eastman Kodak Company, Rochester, N.Y.

[21] Appl. No.: 140,518

[22] Filed: Jan. 4, 1988

[51] Int. Cl.[4] ..... A46B 15/00; G03G 15/06; G03G 21/00; G03G 15/00

[52] U.S. Cl. ..... 355/297; 15/256.5; 118/652; 355/299; 355/300; 430/125

[58] Field of Search ..... 355/15, 16; 118/652; 430/125; 15/1.5, 256.5–256.53

[56] References Cited

U.S. PATENT DOCUMENTS

| | | | |
|---|---|---|---|
| 3,781,107 | 12/1973 | Ruhland . | |
| 3,847,480 | 11/1974 | Fisher . | |
| 4,089,683 | 5/1978 | Knieser . | |
| 4,108,546 | 8/1978 | Rezanka . | |
| 4,110,034 | 8/1978 | Suzuki . | |
| 4,499,849 | 2/1985 | Tomita et al. | 355/15 X |
| 4,518,248 | 5/1985 | Nishikawa | 355/15 |

FOREIGN PATENT DOCUMENTS

| | | | |
|---|---|---|---|
| 23944 | 2/1977 | Japan | 355/15 |
| 198074 | 11/1983 | Japan | 355/15 |
| 107686 | 6/1985 | Japan | 355/15 |
| 23166 | 1/1986 | Japan | 355/15 |

OTHER PUBLICATIONS

*Xerox Disclosure Journal*, vol. 1, Nos. 9/10, Sep./Oct. 1976.

*Primary Examiner*—Arthur T. Grimley
*Assistant Examiner*—Edward Pipala
*Attorney, Agent, or Firm*—Lawrence P. Kessler

[57] ABSTRACT

Apparatus for cleaning particulate matter from a moving web, such apparatus being held in effective cleaning contact therewith. The apparatus includes a member, which is at least partially formed of magnetically attractable material, for engaging the surface of a moving web to be cleaned. Such member is held in cleaning contact with such web by a magnet which is located adjacent to the surface of the web opposite to the surface to be cleaned, and which induces a magnetic field which attracts the member to the web.

3 Claims, 2 Drawing Sheets

APPARATUS FOR CLEANING PARTICULATE MATTER FROM A MOVING WEB

BACKGROUND OF THE INVENTION

This invention is directed in general to apparatus for cleaning particulate matter from a moving web, and more particularly to cleaning residual marking particles from a moving reusable dielectric web in an electrostatographic reproduction device.

In a typical electrostatographic reproduction device, an electrostatic latent image charge pattern, corresponding to information to be reproduced, is produced on a reusable moving dielectric web. Such pattern is developed with pigmented marking particles to form an image which is transferred from the web and permanently fixed to a receiver member. Due to the fact that transfer of the marking particles is not 100% efficient, some residual particles are left on the web. These residual particles must be removed before the particular area of the web is reused or such residual particles may result in unwanted artifacts appearing on the next reproduction which utilizes such area of the web.

Several mechanisms are known for cleaning particulate matter from moving webs, particularly in electrostatographic applications. These mechanisms include, for example, fur brushes, scraper blades, and cleaning belts or webs. Fur brush type cleaning mechanisms generally include a rotating brush operating in an air stream exhausted through a filtering system. Such arrangements are complicated and expensive, and the apparatus creating the air stream generates substantial noise. Further, they tend to produce airborne particles which can cause machine contamination. Scraper blades and cleaning belts are a popular alternative to brush type apparatus in compact equipment where the minimization of machine cost is important. While such cleaning blades and belts are generally effective in the less demanding environment of such compact apparatus, they tend to exhibit difficulty in maintaining their alignment with the web to be cleaned and remaining in effective cleaning contact with such web.

SUMMARY OF THE INVENTION

This invention is directed to an apparatus for cleaning particulate matter from a moving web, such apparatus being held in effective cleaning contact therewith. The apparatus comprises a member, which is at least partially formed of magnetically attractable material, for engaging the surface of a moving web to be cleaned. Such member is held in cleaning contact with such web by a magnet which is located adjacent to the surface of the web opposite to the surface to be cleaned, and which induces a magnetic field which attracts the member to the web.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DESCRIPTION OF THE PREFERRED EMBODIMENTS

Figure 1:
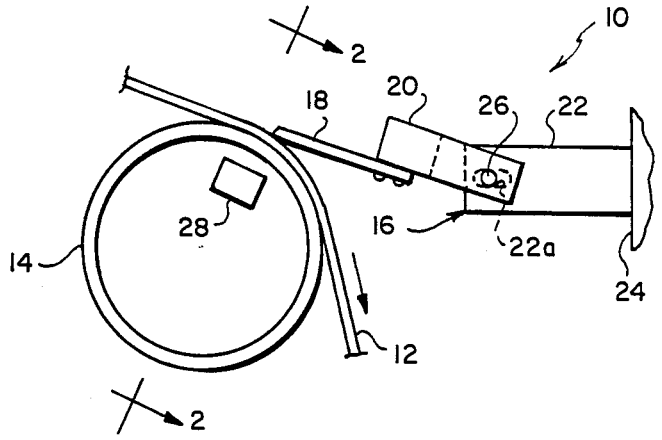
FIG. 1 is a side elevational view of an apparatus for cleaning particulate matter from a moving web, according to this invention.
Figure 2:
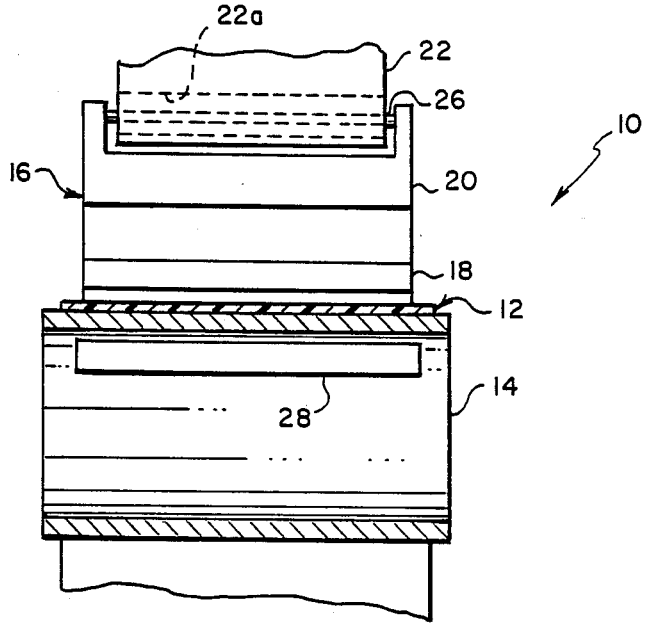
FIG. 2 is an end view of the apparatus of FIG. 1, in cross-section, taken along lines 2—2 of FIG. 1.

Referring now to the accompanying drawings, FIGS. 1 and 2 show a first embodiment of an apparatus, designated generally by the numeral 10, for removing particulate matter M from a moving web 12, according to this invention. The moving web 12 is, for example, a reusable dielectric belt of a typical electrostatographic reproduction apparatus where the belt moves over support rollers 14 (one shown) about a closed loop path. In the reproduction apparatus particulate matter, in the form of pigmented marking particles, are caused to adhere to an electrostatic latent image formed on the surface of the belt opposite to the belt surface engaging the rollers 14. Thereafter the particles are transferred from the belt to a receiver member to form a desired reproduction. On completion of transfer, some residual marking particles remain on the belt surface, and must be removed before that portion of the belt surface can be reused.

The apparatus 10 includes an assembly 16 having an elongated blade 18 removably attached to a holder 20 which is, in turn, pivotably supported by a member 22 fixed to a support frame 24. The member 22 has a slot **22*a* which loosely receives a rod 26 attached to the holder 20. The holder 20 is thus substantially free floating in the member 22 to enable the blade 18 to self align with the web 12 when the blade is placed in juxtaposition with the surface of the web to be cleaned. The blade 18 is formed of a material which is magnetically attractable, such as magnetic stainless steel for example. A magnet 28 is located within the roller 14 adjacent to the zone where the blade contacts the web on the opposite side of the belt from the surface to be cleaned. Such magnet 28 urges the blade into substantially uniform contact with the surface of the web to be cleaned. The strength of the field produced by the magnet 28 is selected to provide sufficient hold-down force on the blade to enable the blade to effectively remove residual marking particles M from the web without damaging the web surface. If desired, the magnet 28 may be relatively positionable within the roller 14 so as to enable the effective hold-down force of its field to be adjustable. Further, the fact that the blade 18 is removably attached to the holder 20** enables the blade to be readily changed when required.

Figure 3:
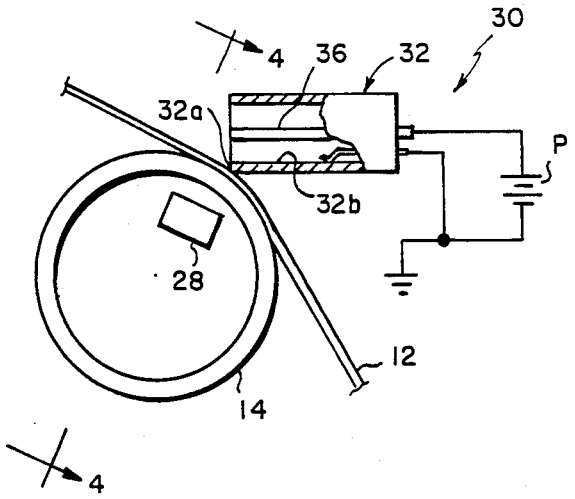
FIG. 3 is a side elevational view of an alternate embodiment of an apparatus for cleaning particulate matter from a moving web, according to this invention.
Figure 4:
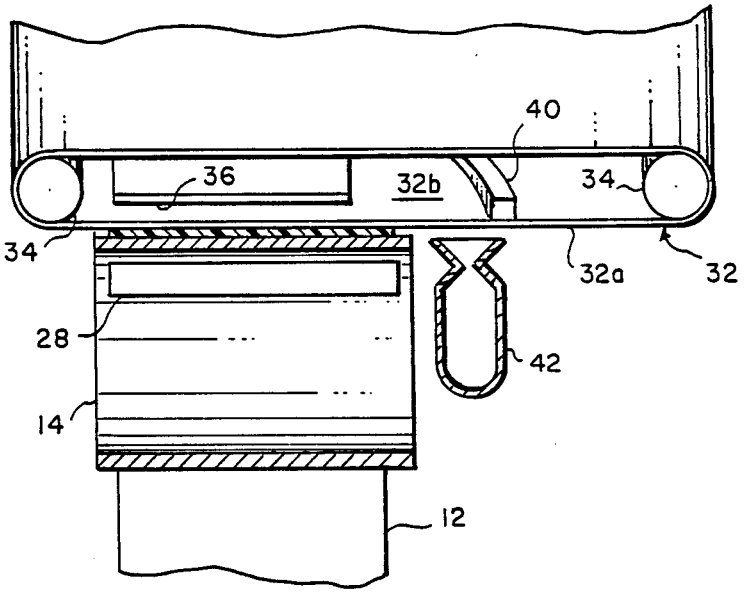
FIG. 4 is an end view of the apparatus of FIG. 3, in cross-section, taken along lines 4—4 of FIG. 3.

FIGS. 3 and 4 show another embodiment, designated generally by the numeral 30, of the apparatus for removing particulate matter from a moving web according to this invention. In this embodiment, the apparatus 30 includes a belt 32 entrained about rollers 34. The belt 32 is formed, at least along an edge **32*a* thereof, of a material which is magnetically attractable, such as magnetic stainless steel for example. One of the rollers 34 is a drive roller which causes the belt 32 to move in a closed loop path about the rollers. The rollers 34 are located outboard of the marginal edge of the web 12, and at an elevation relative to the web surface such that the edge 32*a* of the belt, over at least a portion of its lower run, is in juxtaposition with the surface of the web to be cleaned. The magnet 28 then urges that portion of the edge 32***a* of the belt in juxtaposition with the surface of the web to be cleaned into substantially uniform contact with the web. In a similar manner as described with reference to the embodiment of FIGS. 1 and 2, the hold-down force on the belt edge is sufficient to effectively remove residual marking particles from the web without damaging the web surface.

The particles removed from the web surface by the edge 32*a* of the belt 32 deposit on the inner surface 32*b* of the belt. Movement of the belt 32 carries the removed particles out of the area of contact between the belt and the web. A skieve 40, located within the closed loop path of the belt 32 adjacent to the lower run of the belt outside the area of cleaning contact between the belt and the web, scrapes the residual particles from the belt, and guides the particles off the belt into a collection bottle 42. In this manner, the portion of the belt effecting cleaning of the web is not overloaded with previously removed particles.

The apparatus 30 further includes a metal plate 36 located within the closed loop path of the belt 32 substantially over the area of web/belt contact. A potential source P is connected to the plate 36 to place a charge thereon. The charge is selected to have the same polarity as a charge on the residual marking particles on the web. Accordingly, with the belt 32 connected to ground, any residual marking particles removed from the surface of the web by the belt which become airborne are induced by the electrostatic field produced between the plate 34 and the belt to move back to the inner surface 32*b* of the belt. Such particles are then removed from the belt by the skieve 40 as described above. Thus, contamination due to airborne particles is substantially eliminated.

The invention has been described in detail with particular reference to preferred embodiments thereof, but it will be understood that variations and modifications can be effected within the spirit and scope of the invention.

We claim:

1. Apparatus for cleaning particulate matter from a moving web, said apparatus comprising:

means for engaging the surface of said web to be cleaned, said engaging means including at least a first end formed as a thin blade of magnetically attractable material and a second end, said second end being supported in a floating pivot so as to enable said blade to self align with said web; and means, located adjacent to the surface of said web opposite to said surface to be cleaned, for inducing a magnetic field which attracts said thin blade end of said engaging means and holds said thin blade end in cleaning contact with said web.

2. In an electrostatographic reproduction device wherein an electrostatic latent image charge pattern of information to be reproduced is formed on a moving dielectric web, such pattern is developed with pigmented marking particles for forming a transferable image, and such transferable image is thereafter transferred to a receiver member, apparatus for cleaning residual marking particles from said electric web after transfer, said apparatus comprising;

a continuous belt having at least one edge formed of magnetically attractable material;

means for supporting said belt so that a marginal edge thereof is in juxtaposition with said web, said belt support means including a pair of rollers about which said continuous belt is entrained;

means for rotating at least one of said rollers to transport said belt in a direction transverse to the direction of movement of said web;

an electrically biased plate located between runs of said belt for establishing an electrostatic field for attracting any airborne marking particles to said belt; and means, located adjacent to the surface of said web opposite to said surface to be cleaned, for inducing a magnetic field which attracts said magnetically attractable portion of said belt and holds said portion in cleaning contact with said web.

3. The invention of claim 2 wherein said rollers are respectively located outboard of the marginal edges of said web, and further including a marking particle collection bottle and a skieve member, associated with said continuous belt and said collection bottle, to direct marking particles cleaned from the web by the belt from the belt into said collection bottle.

* * * * *